US005355769A

United States Patent [19]

Kottke

[11] Patent Number: 5,355,769

[45] Date of Patent: Oct. 18, 1994

[54] SEQUENTIALLY OPERATED CYLINDERS WITH LOAD HOLDING VALVE INTEGRATED SYSTEM

[75] Inventor: Kevin D. Kottke, Storm Lake, Iowa

[73] Assignee: Magna Pow'r, Inc., Franklin Park, Ill.

[21] Appl. No.: 919,182

[22] Filed: Jul. 23, 1992

[51] Int. Cl.[5] ..... F01L 21/02

[52] U.S. Cl. ..... 91/184; 91/189 R; 91/189 A; 91/192; 92/111; 92/112

[58] Field of Search ..... 92/111, 112, 113; 91/184, 189 R, 189 A, 191, 192, 193, 358 A, 403, 508

[56] References Cited

U.S. PATENT DOCUMENTS

| | | | |
|---|---|---|---|
| 2,787,383 | 4/1957 | Antos et al. . | |
| 3,250,182 | 5/1966 | Nansel . | |
| 3,300,060 | 1/1967 | Lado . | |
| 3,481,489 | 12/1969 | Stauffer . | |
| 3,610,433 | 10/1971 | Milner, Jr. et al. . | |
| 3,633,460 | 1/1972 | Ohniwa et al. . | |
| 3,657,969 | 4/1972 | Wirkus . | |
| 3,841,494 | 10/1974 | Chalupsky et al. . | |
| 3,871,265 | 3/1975 | Koga et al. | 91/189 R |
| 3,956,970 | 5/1976 | Kupiek et al. | 91/189 A |
| 4,775,029 | 10/1988 | MacDonald et al. . | |

FOREIGN PATENT DOCUMENTS

| | | |
|---|---|---|
| 2310550 | 9/1973 | Fed. Rep. of Germany . |
| 1138381 | 2/1985 | U.S.S.R. . |

*Primary Examiner*—Edward K. Look
*Assistant Examiner*—F. Daniel Lopez
*Attorney, Agent, or Firm*—Barnes & Thornburg

[57] ABSTRACT

In a mechanism for extending or retracting a telescopic unit, the plurality of interconnected cylinders includes an extension passage, a retraction passage and a flow-through passage interconnected to provide a flow path of a retraction signal from the first to the last cylinder and sequencing means for transmitting the retraction pressure signal sequentially from the last cylinder to the first cylinder to initiate retraction from an extended position beginning with the last cylinder. A poppet control check valve provides a position sensitive means to transmit the retraction signal to the next cylinder in the cycle. The sequence control valves and hold loading valves were formed integral to each of the cylinders. The load holding mechanism prevents unintentional extension and retraction movement under the action of the load for each of the cylinders.

28 Claims, 4 Drawing Sheets

SEQUENTIALLY OPERATED CYLINDERS WITH LOAD HOLDING VALVE INTEGRATED SYSTEM

BACKGROUND AND SUMMARY OF THE INVENTION

The present invention relates generally to mechanisms for extending and retracting crane booms and the like, and particularly to mechanisms that extend and retract sequentially. More particularly, the invention relates to sequentially extending and retracting mechanisms utilizing integral control means to control the sequencing of the extension and retraction.

Crane booms and the like are useful devices for lifting and moving loads of various types and allowing access to areas that might otherwise be out of reach. For instance, crane booms make it easier for utility workers to reach the top of utility poles and allow tree trimers to reach the tops of trees, especially where the limbs might not be strong enough to support a person's weight.

It is advantageous to provide the crane booms and the like with extensible and retractable boom sections that telescope within each other in the retracted position. It has been customary to attach a hydraulic cylinder to one section and connect a piston actuated by the cylinder to an adjacent section so that actuation of the hydraulic cylinder provides relative motion between the sections.

Piston and cylinder assemblies for extending and retracting crane booms and the like are known. See, for example, U.S. Pat. No. 3,841,494 to Chalupsky et al.; U.S. Pat. No. 3,633,460 to Ohniwa et al.; U.S. Pat. No. 3,657,969 to Wirkus; U.S. Pat. No. 2,787,383 to Antos et al.; U.S. Pat. No. 3,610,433 to Milner, Jr. et al.; U.S. Pat. No. 3,300,060 to Lado; U.S. Pat. No. 3,250,182 to Nansel; U.S. Pat. No. 3,481,489 to Stauffer; U.S. Pat. No. 4,775,029 to MacDonald et al.; Russian Patent Document No. SU 1138-381; and German Patent Document No. 2 310 550.

Generally, crane booms utilize long hydraulic fluid supply lines that extend the length of the crane boom to supply pressure for actuating the cylinders mounted in the extended sections. Typically, take up reels are necessary to keep the supply lines from becoming entangled or interfering with the extension and retraction of the telescoping sections. Moreover, typical crane booms and the like use mechanical latches alone or in combination with hydraulic valves to sequence the extension and retraction in a predetermined order.

An extension and retraction mechanism that eliminates the long supply lines and take up reels as well as the mechanical latches would be a tremendous improvement over conventional extension and retraction mechanisms. Such a mechanism would be more reliable and maintainable by eliminating equipment that is otherwise subject to failure.

According to the present invention, a mechanism for extending and retracting a telescoping unit includes a plurality of interconnected power cylinders that are movable between an extended and a retracted position. Each cylinder includes an extension passage, a retraction passage, and a flow-through passage. Moreover, each cylinder has hydraulic holding mechanisms for preventing the unintentional movement of the cylinders and sequencers to initiate retraction of the cylinders in sequence, retraction beginning with the last cylinder and extension beginning with the first cylinder.

According to one aspect of the invention, the sequencers include a position sensitive mechanism for blocking fluid flow from traveling from the retracting cylinder to the next cylinder in the retraction sequence until the retracting cylinder is fully retracted. In a preferred embodiment, the sequencer is a poppet control check valve.

According to another aspect of the invention, the holding mechanism is formed to be integral with the power cylinder and includes a one-way check valve and a retraction pressure signal input, and provides a hydraulic lock.

In another preferred embodiment, a mechanism for extending and retracting a telescoping unit includes cylinders formed to include an external wall and a piston having a plurality of passages for transmitting a pressure signal, and load-holding mechanisms for preventing the unintentional retraction of the mechanism under the action of a load. It further includes first valves for controlling the transmission of the pressure signal so that the mechanism extends sequentially in order, and valves for controlling the transmission of the pressure signal so that the mechanism retracts sequentially in reverse order. Moreover, the valves and the load holding mechanism are formed to be integral to the cylinder means.

According to another aspect of the invention, each cylinder is formed to include an extension pressure inlet port, and first and second apertures formed in the external wall. Each piston includes a first passage fluidly connecting the extension pressure inlet port to the first aperture and a second passage fluidly connecting the second aperture to the extension passage in the piston rod. A by-pass boss is formed on the external wall to fluidly connect the first and second apertures, thereby providing fluid communication between the extension pressure inlet port and the extension passage in the piston rod.

According to yet another preferred embodiment, an extension and retraction mechanism comprises a fluid motor including first, second, and third inlet ports and first, second, and third outlet ports. The mechanism also has first mode for activating the fluid motor in a first direction by connecting the first inlet port to the first outlet port. It further includes a passage for circumventing activation of the fluid motor by connecting the second inlet port to the second outlet port, and a second mode for activating the fluid motor in a second direction by connecting the third inlet port to the third outlet port.

Advantageously, the use of three separate passages in the piston and cylinder, the extension passage, the flow-through passage, and the retraction passage, allows hydraulic fluid to flow-through the system internally and eliminates the need for a take-up reel and long supply hoses which could become entangled or interfere with the operation of the system. Moreover, the hoses that are used to interconnect the cylinders of the present invention are short, fixed in position, and are not required to flex. This simplifies the design and eliminates accessory equipment that requires maintenance and is subject to failure.

description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
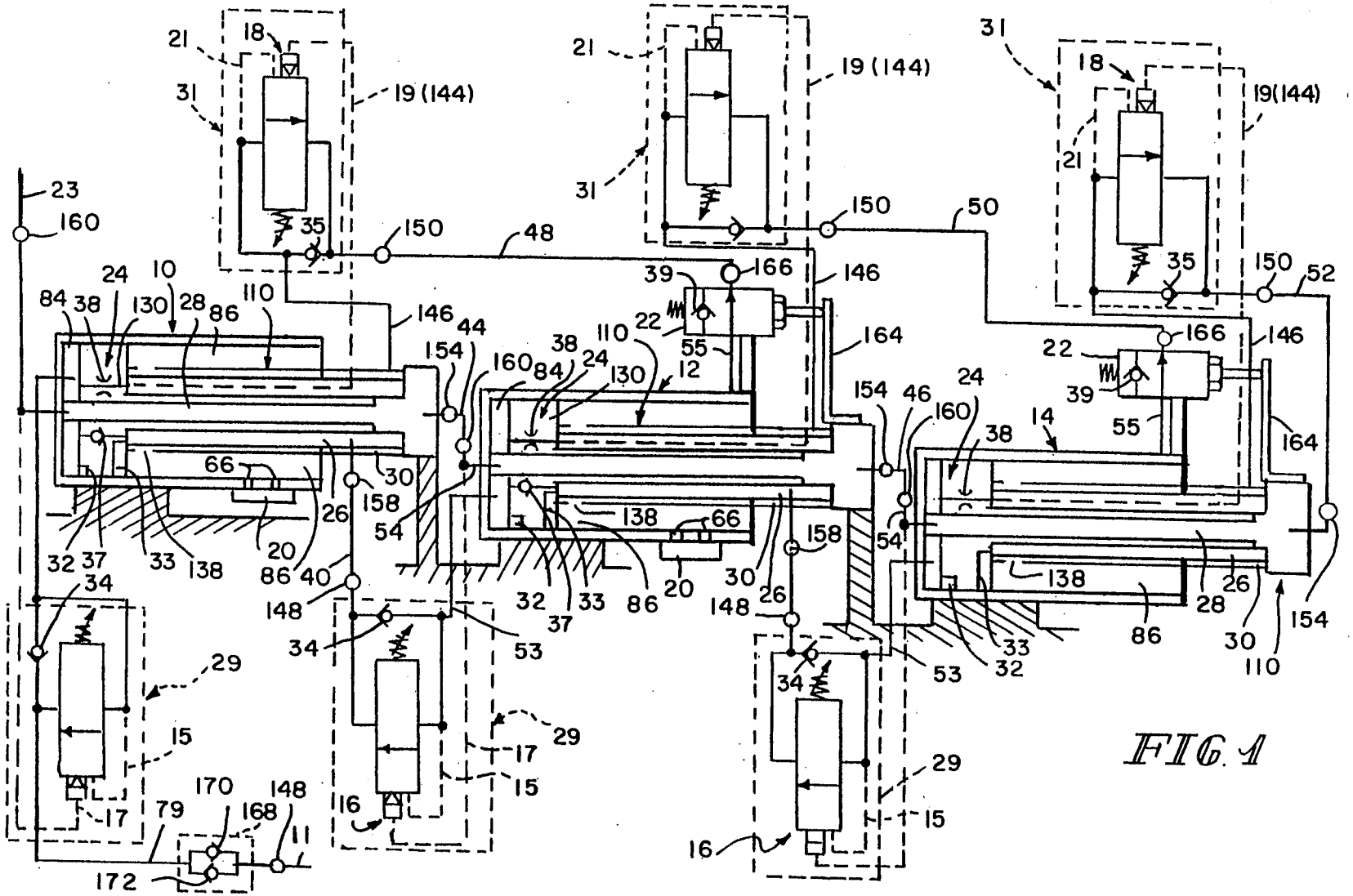
FIG. 1 is a schematic diagram showing the flow path of hydraulic fluid in an apparatus according to the present invention.

The schematic of FIG. 1 shows the pressure signal flow path through a plurality of hydraulic power cylinders 10, 12, 14 for extending and retracting a telescoping unit constructed according to the present invention. Each cylinder includes load holding mechanisms in the form of extend and retract counterbalance valves. The extend counterbalance valves each comprise an extend-load holding valve 16 with its associated one-way check valve 34, and the retract counterbalance valves each comprise a retract-load holding valve 18 with its associated one-way check valve 35. The extend and retract counterbalance valves prevent the unintentional retraction and extension, respectively, of the telescoping unit, as well as overrunning in either direction.

In addition to the extend- and retract-load holding valves, the cylinders include sequencers to ensure that the telescoping unit extends in a predetermined order and retracts in reverse order. The sequencers include by-pass bosses 20 which can act as valves to control the extension of the unit, and except for the first cylinder, poppet control check valves 22. The extend-load holding valve 16, retract-load holding valve 18, and poppet control valves 22 are all spring loaded to the closed position.

Although three cylinders are shown in the drawing, the invention envisions the use of any number of cylinders. For instance, a mechanism according to the present invention could include a first and a last cylinder, and any number (including zero) of intermediate cylinders inserted therebetween.

Figure 2:
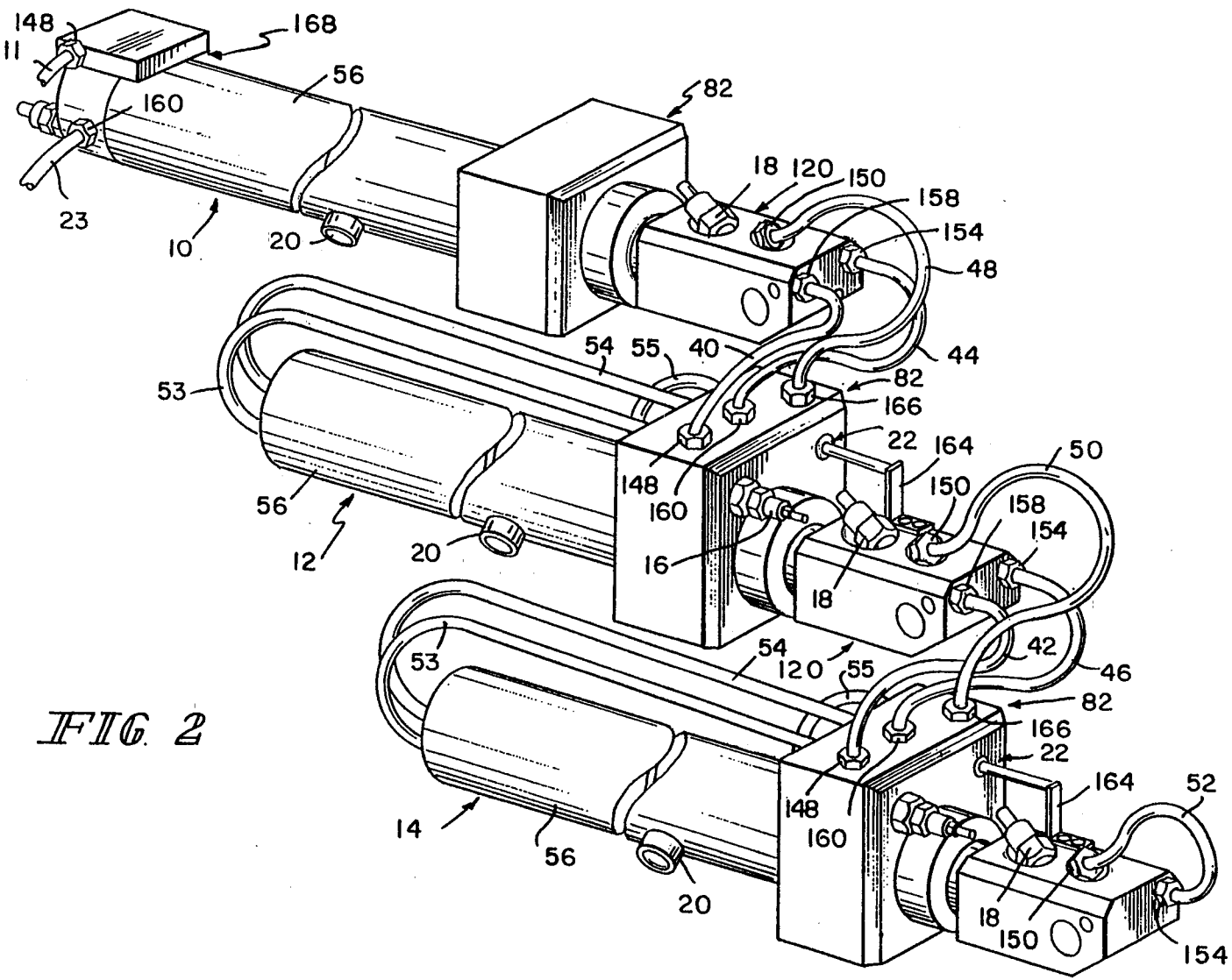
FIG. 2 is a perspective view of three interconnected power cylinders according to the present invention.

All of the cylinders could conceivably be identical to the second cylinder 12 illustrated in FIG. 2, with unused ports and channels plugged as necessary. However, in a preferred embodiment the first cylinder is fluidly connected to an anti-cavitation device and therefore utilizes a different pressure inlet apparatus (as illustrated in FIG. 2). A preferred anti-cavitation device includes two one-way check valves in parallel relationship, with the valves having opposite orientations and thereby permitting fluid flow in the opposite direction. Alternatively, the anti-cavitation device could use a sequencing valve in combination with a one-way valve, or any other combination of devices known in the art that would eliminate cavitation in the system during retraction. The poppet control check valve is also unneeded in the first cylinder (as illustrated in FIG. 2). Moreover, the last cylinder utilizes a tang (illustrated in FIG. 5) that is different from the tangs on the rest of the cylinders, and doesn't utilize the by-pass boss and several internal passages formed in the piston, which can be eliminated.

As shown in FIG. 1, the cylinders 10, 12, 14 are in the fully retracted position. When extension pressure is applied to the system, the hydraulic fluid is limited to extending the first piston and cylinder 10 until the piston 24 reaches a predetermined extension. At that position, the by-pass boss 20 routes the fluid from the extension chamber 84 around the piston 24 using passages 32, 33 and into an internal extension passage 26 formed in the piston rod. This allows the fluid to flow to the next cylinder 12 in the extend sequence. Repeating the process for each cylinder up to the last cylinder in the series ensures that the cylinders extend in sequence only after the preceding cylinder has fully extended.

During retraction, the fluid is routed through internal flow-through passages 28 formed in the piston rods for unopposed travel to the last cylinder 14. After flowing through the flow-through passage 28 of the last cylinder 14, the fluid is routed to an internal retraction passage 30 formed in the piston rod to the retraction chamber 86 of the cylinder. After the piston 24 has retracted, a position sensitive poppet valve 22 opens to allow the retraction pressure to travel to the next cylinder 12 to be retracted, and so on until all of the pistons and cylinders have retracted in sequence.

The anti-cavitation device 168 positioned at the input side of the first cylinder 10 incorporates two one-way check valves 170, 172 connected in parallel as illustrated in FIG. 1. The check valves 170, 172 cooperate to create a back pressure in the extend side of all of the cylinders 10, 12, 14 in the sequence during retraction. The back pressure eliminates cavitation in the cylinders in the event air is inadvertently introduced into the cylinders.

Examining the extension sequence in more detail, it will be seen that extension pressure 11 is introduced into the first cylinder 10 in the extend sequence. The hydraulic fluid passes through the extension pressure inlet port 148, an anti-cavitation device 168, through the one-way check valve 34 of the extend counterbalance valve 29 bypassing the extend-load holding valve 16, and enters the extension chamber 84 of the first cylinder 10 causing the piston 24 to extend or move to the right in FIG. 1.

At the same time, an orifice plug or restriction 38 in the piston 24 allows an extension pilot pressure signal 19 to be sent in order through passages 130, 26, and 144 to the retract-load holding valves 18. The extension pilot pressure signal 19 combines with the back pressure 21 from the retraction chamber 86 to open the retract-load holding valves 18 bypassing one-way check valve 35. The back pressure 21 from the retraction chamber 86 of the cylinders is caused by the extending movement of the pistons 24 and is transmitted via passage 30 in the piston rod. The open retract-load holding valve 18 allows the fluid trapped in the retraction chamber of the cylinders to flow to the retraction chamber 86 of the next cylinder via open position-sensitive poppet valve 22 and eventually back to a reservoir (not shown) through the internal flow-through passage 28 in the cylinders 10, 12, 14 during the extend sequence. When the extension pressure 11 is removed from the system, the pilot pressure signal 19 is removed from the retract-load holding valves 18, returning the valves 18 to the closed position and providing a hydraulic lock to prevent inadvertent extension of the system.

When the piston 24 has extended a predetermined distance, passages 32, 33 formed in the piston 24 align with the by-pass boss 20 which routes hydraulic extend fluid pressure from the extension chamber 84 to an internal extension passage 26 running the length of the piston rod. The hydraulic fluid exits the first cylinder 10 at the distal end of the rod through the extension pressure outlet port 158. It is then routed via a hose 40 to the extension pressure inlet port 148, passes through extend-load holding valve 16, and then via connecting tube 53 to the extension chamber 84 of the second cylinder 12. The process is repeated for each cylinder in the sequence until the hydraulic pressure is turned off or the final cylinder in the sequence has fully extended.

The cylinders are retracted by initially sending retraction pressure 23 to the flow-through inlet port 160 of the first cylinder 10 where it enters an internal flow-through passage 28. A retraction pilot pressure signal 17 is simultaneously transmitted to all of the extend-load holding valves 16 to combine with a back pressure signal 15 from the extension chamber 84 of the retracting pistons to open the extend-load holding valves 16. The hydraulic fluid flows through the flow-through passage 28 of the first cylinder 10 and out the flow-through outlet port 154. It then travels via hose 44 to the flow-through inlet port 160 of the second cylinder 12, and then via connecting tube 54 to the flow-through passage 28 of the second cylinder 12.

The hydraulic fluid continues its unobstructed flow through the internal flow-through passages 28 of all the cylinders 10, 12, 14 in the sequence until it reaches the last cylinder 14. From the flow-through passage 28 of the last cylinder 14, the fluid is routed via passage 162 (FIG. 5) through the retract-load holding valve 18 to an internal retraction passage 30 and then through passage 138 to a retraction chamber 86. The fluid entering the retraction chamber 86 causes the piston 24 to retract in the cylinder 14.

Retraction of the piston 24 causes the fluid in the extension chamber 84 to be compressed, sending a back pressure signal 15 to all of the extend-load holding valves 16, where it combines with the retraction pilot pressure signal 17 to open the extend-load holding valve 16 to allow the fluid in the extension chamber 84 to bypass check valve 34 and backflow to the extension passage 26 of the piston rod of the next cylinder 12 in the sequence. The backflow continues through the extension passage 28 and, via the by-pass boss 20 and passages 32, 33 (FIG. 4), to the extension chamber 84 in cylinder 12. The back pressure signal 15 combines with the retraction pilot pressure signal 17 to open the remaining extend-load holding valves 16, bypassing check valves 34, thereby allowing the trapped extension fluid to escape to a reservoir (not shown).

When the cylinder 14 has fully retracted, a position-sensitive poppet control check valve 22 is mechanically opened by contact with bracket 164 which is attached to the piston rod 110, bypassing one-way check valve 39 in the poppet valve 22, allowing retraction fluid to be routed through connecting tube 55 through the poppet control check valve 22, and out the retraction pressure outlet port 166. The fluid is then routed via hose 50 to the retraction pressure inlet port 150 on the next cylinder 12 to be retracted, and then through a one-way check valve 35. The fluid is directed to the internal retraction passage 30 and then to a retraction chamber 86 via passage 138 causing the piston 24 in the second cylinder 12 to retract. The process is repeated for each piston and cylinder in the sequence until the retraction pressure 23 is removed from the system or until the final cylinder 10 in the sequence has fully retracted.

FIG. 2 is a perspective view of three cylinders 10, 12, 14 generally constructed according to the present invention. Typically, the internal workings of the cylinders 10, 12, 14 can be identical. However, in a preferred embodiment, the last cylinder does not need the internal passages 32, 33 and the orifice 38 formed in the piston body.

As illustrated in FIG. 2, the inlet end of the first cylinder 10, on the left as seen in FIG. 2, differs from the inlet end of cylinders 12, 14. The extend-load holding valve 16 of the first cylinder 10 is physically located at the inlet end. This allows the hydraulic fluid to be introduced directly to the cylinder and eliminates the necessity of running a supply hose from the pressure source to the flange 82 along the length of the cylinder. It also eliminates the need for connecting tubes 53, 54. Moreover, in a preferred embodiment, extension fluid is routed through an anti-cavitation device 168 which is located at the inlet end of the first cylinder. However, for inventory management or other reasons, the anti-cavitation device could be physically separate from the first cylinder and the first cylinder could be identical to the others in the sequence, with any unused ports being plugged.

Figure 5:
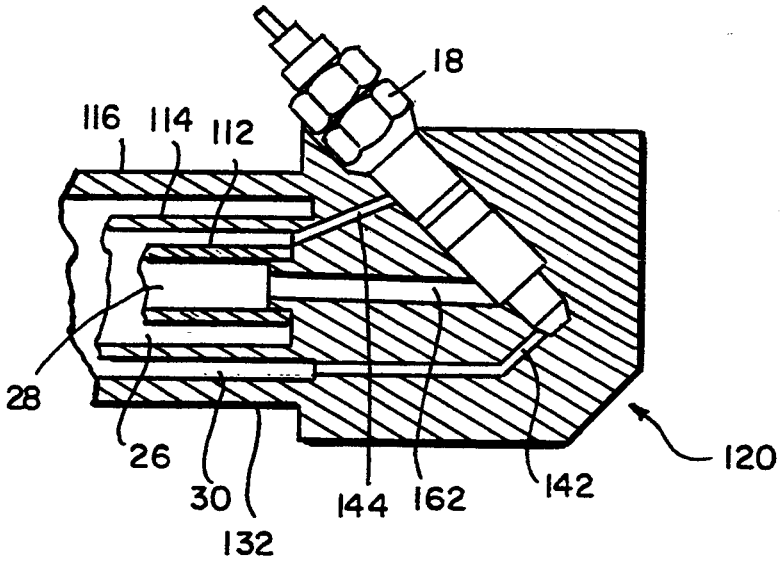
FIG. 5 illustrates an alternative embodiment of the tang formed on the last cylinder in the sequence.

As seen in FIG. 2, the last cylinder 14 in the sequence the extend pressure outlet port 158 is plugged. An alternative embodiment of the tang 120, as shown in FIG. 5, provides a direct connection between the flow-through passage 28 and the retract-load holding valve 18 on the last cylinder in the sequence, thereby eliminating the need for hose 52.

As presently perceived, the tang 120 of one cylinder is physically mounted to the same structural element of the telescoping unit as the flange 82 of the next cylinder in the sequence. In this manner, the second cylinder 12 extends and retracts as a unit with the tang 120 of the first cylinder 10, yet allows for a minimum length when the unit is retracted. On the other hand, if the cylinders were to be connected tang to inlet end, a greater maximum extension would be possible, but the retracted length of the telescoping unit would be commensurately longer. Obviously, other physical layouts are possible.

As extension pressure 11 is applied to the first cylinder 10 and the piston 24 extends, extension fluid travels out of the extend pressure outlet port 158, through hose 40, to the extend pressure inlet port 148 of cylinder 12. From the inlet port 148, the extension fluid travels through connecting tube 53 to the extension chamber in cylinder 12. Travelling through passages as previously described, the extend fluid exits the extension pressure outlet port 158 of cylinder 12, passes through hose 42, to the extension pressure inlet port 148 on cylinder 14, and then through connecting tube 53 to the inlet side of cylinder 14.

When retraction pressure is applied, it travels through the flow-through passage of cylinder 10 to the flow-through outlet port 154, through hose 44 to the flow-through inlet port 160 on cylinder 12, and then through connecting tube 54 to the inlet end of cylinder 12. After flowing through the flow-through passages of cylinder 12, the fluid exits the flow-through outlet port 154 of cylinder 12, to pass through hose 46 to the flow-through inlet port 160 and connecting tube 54 of cylinder 4.

After flowing through cylinder 14, the fluid exits the flow-through outlet port 154 of cylinder 14, through hose 52 to the retract pressure inlet port 150 of cylinder 14. It then flows through the retract passage 30 to the retraction chamber 86, causing the piston to retract in the cylinder 14.

In a preferred embodiment, as shown in FIG. 5, the fluid flows directly from the flow-through passage 28 through the internal channel 162 to the retract-load holding valve 18. The fluid flows through the retract-load holding valve 18 to the retract passage 30 and then to the retraction chamber 86.

When the cylinder 14 has fully retracted, bracket 164 opens the poppet control check valve 22 allowing retraction fluid to travel from the retraction chamber in cylinder 14 through connecting tube 55, through the poppet control check valve 22 to the retraction pressure outlet port 166. From the outlet port 166, retraction fluid travels through hose 50 to the retraction pressure inlet port 150 of cylinder 12. The process is repeated for cylinder 12, with retraction fluid traveling through connecting tube 55, out the retraction pressure outlet port 166, and through the hose 48 to the retraction pressure inlet port 150 of the cylinder 10.

Figure 3:
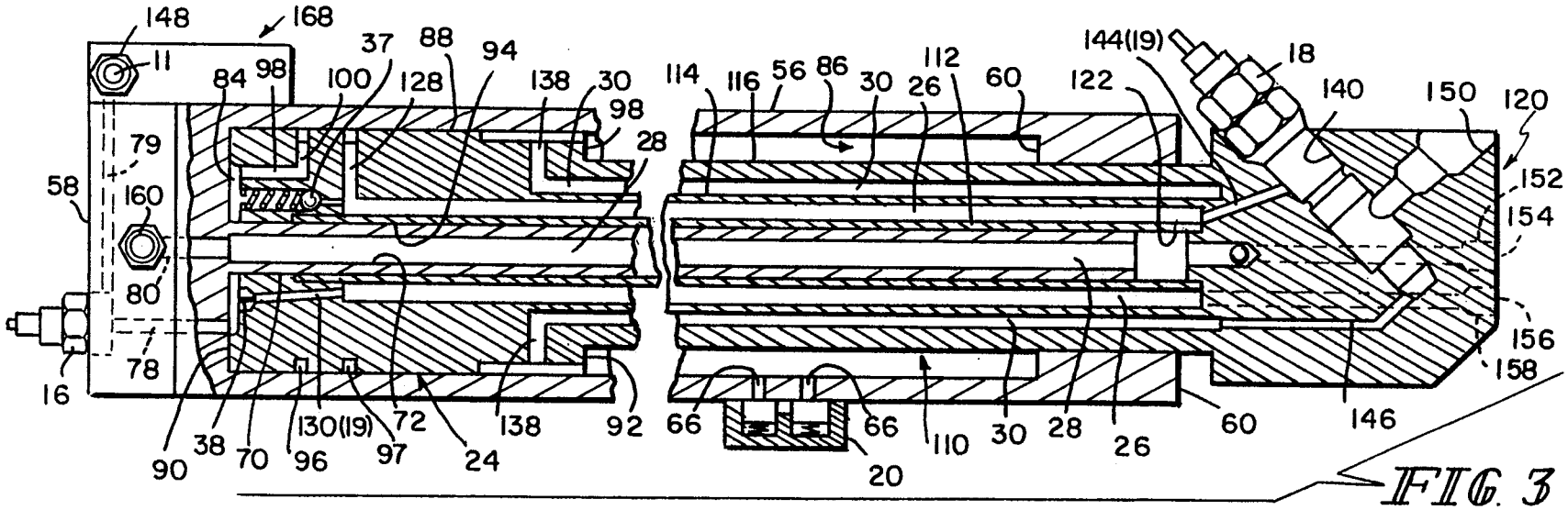
FIG. 3 is a longitudinal section taken through a first cylinder illustrating the three internal passages inside the piston rod, with the piston in the fully retracted position.
Figure 4:
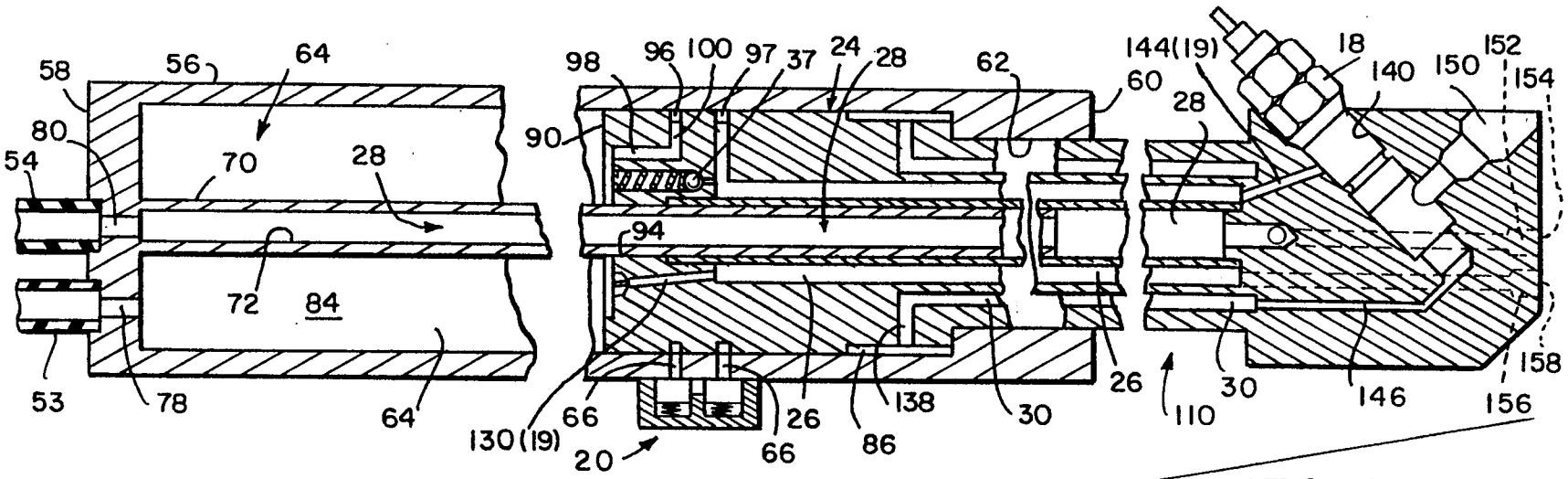
FIG. 4 is the same as FIG. 3, but showing the end of a second cylinder in the sequence, with the piston in the fully extended position.

A piston and cylinder constructed according to the present invention is shown in the fully retracted position in FIG. 3 and in the fully extended position in FIG. 4. FIG. 3 shows the inlet end of a preferred first cylinder 10 in the extend sequence, while FIG. 4 shows the inlet end of the remaining cylinders in the sequence.

The cylinder 10 includes a cylindrical side wall 56 having a predetermined internal diameter, a first end wall 58 attached to a proximal end of the side wall 56, and a second end wall 60 attached to a distal end of the side wall 56 and formed to include an aperture 62. The side wall 56 and the first and second end walls 58, 60 cooperate to define an interior bore 64 divided by the piston 24 into an extension chamber 84 and a retraction chamber 86. Two radial apertures 66 are formed in the cylindrical side wall 56 to communicate with the interior bore 64. The by-pass boss 20 is formed on the cylinder 0 to provide a connection between the two apertures 66 on the outside of the cylinder side wall 56. A central annular projection 70 extends axially substantially along the length of the cylinder from the first end wall 58 through the interior bore 64 to form a first axial channel 72. For clarity, the flanges 82 depicted in FIG. have been deleted from cylinders illustrated in FIGS. 3–4.

The first end wall 58 is formed to include an extension pressure passage 78 which connects connecting tube 53 (FIG. 4), or the extension pressure inlet port 148 (FIG. 3), to the extension chamber 84. In a preferred embodiment, illustratively shown in FIG. 2, the anti-cavitation device 168 is connected to the first end wall 58. A vertical passage 79 connects the anti-cavitation device 168 to the extend-load holding valve 16 and to the extension pressure passage 78.

The first end wall 58 also includes a retraction pressure passage 80 that extends through the first end wall 58 and connects the flow-through inlet port 160 (FIG. 3), or the connecting tube 54 (FIG. 4), to the first axial channel 72. The connecting hose outlet connects to a passage 80 extending through the first end wall 58 and opening into the first axial channel 72.

A piston 24 having a diameter substantially equal to the internal diameter of the cylindrical side wall 56 sealingly slides into the interior bore 64 and divides the interior bore 64 into an extension chamber 84 and a retraction chamber 86. The piston 24 is formed to include a body 88 having an extend face 90 positioned adjacent the extension chamber 84, a retract face 92 positioned adjacent the retraction chamber 86, an axially extending central aperture 94, and perimetral grooves 96, 97 extending around the body 88 and axially located between the extend face 90 and the retract face 92. An axially extending passage 98 is bored into the extend face 90 of the piston and communicates with a radial passage 100 that extends from a first of the perimetral grooves 96 to form passage 32. The axially extending passage 98 and the radial passage 100 cooperate to allow hydraulic fluid to travel from the extension chamber 84 to the first perimetral groove 96.

A piston rod 110 having a proximal end attached to the retract face 92 of the piston 24 extends along the length of the retraction chamber 86 of the cylinder 10 and sealingly passes through the central aperture 62 in the second end wall 60. The piston rod 110 is formed to include three concentric sleeves 112, 114, 116 connected to the piston body 88 and extending axially along the length of the piston rod 110. The concentric sleeves 112, 114, 116 are attached to a tang 120 at the distal end of the piston rod 110.

The radially innermost concentric sleeve 112 defines a second axially extending central channel 122 that is aligned with and communicates with the central aperture 94 in the piston body 88. The second axially extending channel 122 slidably and sealingly engages the central annular projection 70 of the first end wall 58 of the cylinder. The first and second axial channels 72, 122 cooperate to define a central flow-through passage 28 that extends from the retraction pressure passage 80 in wall 58 of the cylinder and fluidly communicates with the flow-through outlet port 154 in the tang 120. The flow-through passage 28 axially lengthens and shortens with the movement of the piston 24 in the cylinder 10 during extension and retraction, respectively.

A radially intermediate concentric sleeve 114 cooperates with the innermost sleeve 112 to define an internal extension passage 26 extending axially along the length of the piston rod 110. The extension passage 26 communicates with the second of the perimetral grooves 97 formed in the piston body 88 by a radial passage 128 and together passages 26 and 128 form passage 33 shown in FIG. 1. The extension passage 26 is also in fluid communication with the extension chamber 84 by a small orifice 130 extending therebetween through the piston body 88. A plug 38 formed in the orifice 130 is sized to allow fluid pressure signals to be transmitted between the extension chamber 84 and the extension passage 26, while minimizing fluid flow therebetween.

A ball check valve 37 also connects the extension chamber 84 and the extension passage 26. The check valve 37 allows for a more rapid retraction of cylinder 14 in the event of an out-of-sequence condition wherein cylinder 14 is extended while cylinder 12 is retracted. In the out-of-sequence condition, the piston 24 in cylinder 12 has moved away from the by-pass boss 20, and the only remaining passage for allowing the backflow of extension fluid from cylinder 14 would by the orifice 130. The check valve 37 provides a larger passage than the orifice 130 to accommodate the back flow of extension fluid during retraction. However, it still blocks extension fluid from reaching the extension passage 26 during extension. In a preferred embodiment, the check valve 37 is unnecessary and can be eliminated from the last cylinder 14 in the sequence.

A radially outermost concentric sleeve 116 forms the outer wall 132 of the piston rod 110 and has an outer diameter that is smaller than the internal diameter of the cylindrical side wall 56. The outermost sleeve 6 cooperates with the cylindrical side wall 56 to define a retraction chamber 86 that axially extends along the piston rod 110 between the retract face 92 and the second end wall 60. The outermost sleeve 116 also cooperates with the intermediate sleeve 114 to define an internal retraction passage 30. A connecting passage 138 extends radially between the retraction passage 30 and the retraction chamber 86.

The tang 120 attached to the distal end of the piston rod 110 is formed to include an aperture 140 for receiving a retract counterbalance valve 31 of conventional design. The retract-load holding valve receiving aperture 140 is fluidly connected to the internal extension passage 26 via an extension pressure signal channel 144 to receive pilot pressure signal 19, to the retraction passage 30 via a retraction passage continuation 146, and to a retraction fluid supply hose (48, 50, 52 in FIG. 2) via a retraction pressure inlet port 150.

A flow-through passage continuation 152 passes through the tang 120 to connect the flow-through passage 28 with a flow-through outlet port 154 (see FIG. 2) formed in the tang 120. An extension passage continuation 156 passes through the tang 120 to connect the extension passage 26 to an extension pressure outlet port 158 (see FIG. 2) formed in the tang 120. The extension pressure outlet port 158 is connected by hose 40, 42 (see FIG. 2) to the extension pressure inlet port 148 of the next cylinder 12, 14, respectively, in the sequence to be extended. The flow-through outlet port 154 is connected by hose 44, 46 (see FIG. 2) to a flow-through inlet port 160 (see FIG. 2) on the next cylinder 12, 14, respectively, in the sequence to be extended. In the case of the last cylinder 14 in the sequence, the flow-through outlet port 154 is connected by hose 52 (see FIG. 2) to the retraction pressure inlet port 150 of the last cylinder 14. In the alternative embodiment of FIG. 5, the flow-through outlet port 154 is directly connected to the retract-load holding valve 18 by internal channel 162.

Although not shown in the drawings, conventional hydraulic fittings and sealing means are used throughout the invention to reduce the likelihood of fluid leaks.

In operation, hydraulic pressure is applied to the extend face 90 of the piston 24 in the first cylinder 10 causing the piston 24 to extend. When the piston 24 has extended a predetermined amount, the first and second perimetral grooves 96, 97 will align with the by-pass boss 20 formed on the cylinder 10. When the perimetral grooves 96, 97 are aligned with the by-pass boss 20, hydraulic fluid passes from the extend face 92 of the piston 24 through the passages 98, 100 connecting the extend face 90 with the first perimetral groove 96, through the by-pass boss 20 to the second perimetral groove 97, and by internal passage 128 to the extension passage 26. The extension pressure is then allowed to pass through the extension passage 26 and extension passage continuation 156 in the tang 120 to the extension pressure outlet port 158. Advantageously, the by-pass boss 20 allows for internal fluidic sequencing of the extension process. The by-pass boss 20 prohibits the extension of follow-on cylinders until the preceding cylinder in the sequence has fully extended.

When pressure is first applied to the extend face 90 of the piston 24, a pilot pressure signal 19 travels through the orifice plug 38, the extension passage 26, and the extension pilot pressure signal channel 144 to the retract-load holding valves 18. This extension pilot pressure signal 19 combines with the pressure 21 formed in the retraction chamber 86 caused by the movement of the piston 24 to open the retract-load holding valves 18 and allow the fluid trapped in the retraction chambers 86 of the cylinders to back flow out of the cylinders to the retraction chamber 86 in the next cylinder and finally through the flow-through passages 28 of the cylinders to a reservoir.

To retract the cylinders, retraction pressure 23 is applied at the flow-through inlet port 160 and fluid is allowed to flow through the flow-through passages 28 and flow-through passage continuations 152 and outlet port 154 until it reaches the end of the final cylinder 14 of the sequence. In the final cylinder 14, the flow-through outlet port 154 is connected to the retraction pressure inlet port 150 by hose 52, as depicted in the schematic of FIG. 1 and shown in FIG. 2, or by direct connection through internal channel 162, as shown in the alternative embodiment of FIG. 5.

During retraction, a retraction pilot pressure signal 17 is transmitted from the flow-through inlet port 160 on the flange 82 to the extension pressure inlet port 148 on the flange 82. The retraction pilot pressure signal 17 travels via an internal passage in the flange (not shown). The retraction pilot pressure signal 17 combines with the back pressure 15 formed in the extension chamber 84 of the cylinder 14 by retraction movement of the piston 24 to open the extend-load holding valve 16 to allow the fluid trapped in the extension chamber 84 to escape back through the cylinders to a reservoir (not shown).

The retraction fluid travels from the retraction pressure inlet port 150 through the one-way check valve 35 (FIG. 1), the retraction passage continuation 146, the retraction passage 30 and connecting passage 138, and into the retraction chamber 86, where the pressure causes the piston 24 to move. When the piston 24 has fully retracted, a bracket 164 (FIGS. 1–2) mounted on the piston rod mechanically opens a poppet valve 22 (FIGS. 1–2) allowing the retraction fluid to pass out of the cylinder and to the retraction pressure inlet port 150 in the next cylinder to be retracted in the sequence. The process is repeated until all of the cylinders have been retracted, or until retraction pressure is turned off.

Advantageously, the use of the integral poppet valves 22 ensures that the retraction pressure is restricted to the first cylinder to be retracted until retraction is complete before being transmitted to the next cylinder to be retracted. Moreover, the hoses connecting the cylinders 10, 12, 14 do not flex after installation, thereby reducing wear and tear on the hoses and improving maintainability.

Although the invention has been described in detail with reference to a certain preferred embodiment, variations and modifications exist within the scope and spirit of the invention as described and defined in the following claims.

What is claimed is:

1. A mechanism for extending and retracting a telescoping unit, the mechanism comprising:

a plurality of interconnected power cylinders, each movable between an extended position and a retracted position and having a flow-through passage in each cylinder interconnected to provide an unobstructed flow path for a retraction pressure signal from a first cylinder through to a last cylinder, and;

sequencing means for transmitting said retraction pressure signal sequentially from said last cylinder to said first cylinder to initiate retraction of the cylinders from an extended position in sequence beginning with said last cylinder;

2. The mechanism of claim 1, including load holding means for each cylinder which includes a one-way check valve to allow fluid flow in a first direction in parallel with a load holding valve to allow fluid flow in the opposite direction in response to a pilot control signal.

3. The mechanism of claim 2, wherein said holding means includes a retraction holding means responsive to a first pilot signal to activate said load holding valve to allow fluid to flow from a first expansion chamber of a cylinder.

4. The mechanism of claim 2, wherein said holding means includes an extension holding means responsive to a second pilot signal to activate said load holding valve to allow fluid to flow from a second expansion chamber of a cylinder.

5. The mechanism of claim 1, wherein each cylinder includes a holding means which includes a one-way valve and an extension pilot pressure signal input and provides a hydraulic lock to prevent the inadvertent retraction of the mechanism.

6. The mechanism of claim 5, wherein the holding means is formed to be integral to the power cylinders.

7. An extension and retraction mechanism comprising:

a fluid motor including first, second, and third inlet ports and first and second outlet ports;

first means for connecting a pressure signal input at the first inlet port, which activates the fluid motor in a first direction, to the first outlet port once said mechanism has reached a first predetermined position;

passage means for circumventing activation of the fluid motor and connecting the second inlet port and the second outlet port so that a pressure signal input at the second inlet port travels to the second outlet port without activating the fluid motor; and second means for connecting a pressure signal input at the third inlet port to activate the fluid motor in a second direction.

8. A mechanism for extending and retracting a telescoping unit including a plurality interconnected cylinder means for extending and retracting the mechanism, and further comprising:

load holding means for preventing the unintentional extension and retraction of the mechanism under the action of a load, and being integral to each of said cylinder means;

first valve means for controlling the transmission of a pressure signal between the cylinder means to extend the cylinder means so that the mechanism extends sequentially in order, and being integral to each cylinder means except a last cylinder means, and second valve means for controlling the transmission of a pressure signal between the cylinder means to retract the cylinder means so that the mechanism retracts sequentially in reverse order, and being integral to each cylinder means except a first cylinder means.

9. The mechanism of claim 8, wherein the load holding means includes hydraulic lock means for blocking the flow of hydraulic fluid from the cylinder means and locking a piston within each of said cylinder means.

10. The mechanism of claim 9, wherein the hydraulic lock means includes retract-load holding valve for preventing the unintentional extension of the mechanism under the action of a load.

11. The mechanism of claim 9, wherein the hydraulic lock means includes an extend-load holding valve for preventing the unintentional retraction of the mechanism under the action of a load.

12. The mechanism of claim 8, wherein the cylinder means includes a piston having an extension passage connect to said first valve means, a retraction passage connected to said second valve means, and a flow-through passage connected to a flow-through inlet and outlet for transmitting a pressure signal through said cylinder means without moving said piston.

13. The mechanism of claim 12, wherein the cylinder means includes an extension pressure inlet port and outlet port and the first valve means includes by-pass means for directing the pressure signal from the extension pressure inlet port to the extension passage in the piston to said outlet port when the piston has reached a predetermined position.

14. The mechanism of claim 13, wherein the cylinder means is formed to include first and second apertures and the piston includes a first passage fluidly connecting the extension pressure inlet port and the first aperture and a second passage fluidly connecting the second aperture and the extension passage in the piston rod when the piston is at a predetermined position and the by-pass means includes a by-pass boss formed on the cylinder wall fluidly connecting the first and second apertures in the cylinder wall.

15. The mechanism of claim 12, wherein the second valve means includes position sensitive means for directing the retraction pressure signal to the next cylinder in sequence to be retracted when the piston has reached a predetermined retracted position.

16. The mechanism of claim 15, wherein the position sensitive means includes a poppet valve movable between a flow-through position to allow a retraction pressure signal to travel to the next cylinder in the retract sequence and a check valve position to block the retraction pressure signal from traveling to the next cylinder in the retract sequence.

17. An extension and retraction mechanism comprising:

a fluid motor including first, second, and third inlet ports and first, second, and third outlet ports, and first means for connecting the first inlet port and the first outlet port once said mechanism has reached a first predetermined position so that a pressure signal input at the first inlet port, which activates the fluid motor in a first direction, travels to the first outlet port, passage means for circumventing activation of the fluid motor and connecting the second inlet port and the second outlet port so that a pressure signal input at the second inlet port travels to the second outlet port without activating the fluid motor, and second means for connecting the third inlet port and the third outlet port when said mechanism has reached a second predetermined position so that a pressure signal input at the third inlet port which activates the fluid motor in a second direction, travels to the third outlet port.

18. The mechanism of claim 17, wherein the first means includes a plurality of internal passages fluidly connecting the first inlet and outlet ports, and the second means includes a plurality of internal passages fluidly connecting the third inlet port and the third outlet port.

19. The mechanism of claim 18, wherein the first means further includes by-pass means for shunting a fluid pressure signal between two apertures formed in the fluid motor and connecting separated internal passages between said first inlet and outlet ports.

20. The mechanism of claim 19, wherein the by-pass means and the separated internal passages combine to define an unobstructed passage connecting the first inlet port and the first outlet port when the fluid motor has reached said first predetermined position.

21. The mechanism of claim 17, wherein the second activating means includes position sensitive means for restricting the passage of a pressure signal to said third outlet until the fluid motor has reached said second position.

22. In a hydraulic extension and retraction mechanism having a pressure source and a plurality of interconnected independent hydraulic piston and cylinder assemblies that react to a pressure signal generated by the pressure source to extend and retract between an extended position and a retracted position, the improvement being that each of said hydraulic assemblies comprises a piston formed to include a retraction passage, an extension passage, a flow-through passage, first integral control means cooperating with said extension passage of all except a last hydraulic assembly for ensuring that the mechanism extends in a predetermined order, second integral control means cooperating with said retraction passage of all except a first hydraulic assembly for ensuring that the mechanism retracts in a sequence opposite to the predetermined order, and a flow-through inlet and outlet cooperating with said flow-through passage for transmitting a pressure signal through said cylinder without moving said piston.

23. The mechanism of claim 22, wherein the first control means includes means for directing the pressure signal from a first cylinder to be extended to a second cylinder to be extended after the first cylinder is fully extended.

24. The mechanism of claim 23, further comprising a cylinder having an extension pressure inlet port and a cylindrical side wall having first and second apertures and the piston includes a first passage fluidly connecting the extension pressure inlet port and the first aperture and a second passage fluidly connecting the extension passage in the piston rod and the second aperture when the piston is at a predetermined position and means formed on the cylinders for shunting a pressure signal from the first aperture to the second aperture.

25. The mechanism of claim 24, wherein the second means includes position sensitive means for blocking the passage of a retraction pressure signal until the first cylinder to be retracted is fully retracted.

26. The mechanism of claim 22, wherein the second control means includes means for directing the pressure signal to a second cylinder to be retracted after the first cylinder to be retracted has fully retracted.

27. A mechanism for extending and retracting a telescoping unit, the mechanism comprising:

a plurality of interconnected power cylinders, each movable between an extended position and a retracted position; and position sensitive means including a poppet control check valve for blocking fluid flow travelling from a retracting cylinder to a next cylinder to retract in a retraction sequence until the retracting cylinder is fully retracted.

28. The mechanism of claim 27, wherein each cylinder includes a retraction holding means responsive to a first pilot signal to activate a first load holding valve to allow fluid to flow from a first expansion chamber of a cylinder and an extension holding means response to a second pilot signal to activate a second load holding valve to allow fluid to flow from a second expansion chamber of a cylinder.

* * * * *